US005755340A

United States Patent [19]

Weingartner

[11] Patent Number: 5,755,340

[45] Date of Patent: May 26, 1998

[54] HOLDER FOR A NOTEPAD

[75] Inventor: Bernhard Weingartner, Feldkirch, Austria

[73] Assignee: Neutrik Aktiengesellschaft, Schaan, Liechtenstein

[21] Appl. No.: 732,633

[22] Filed: Oct. 16, 1996

[51] Int. Cl.[6] ..... A47F 7/00

[52] U.S. Cl. ..... 211/50; 206/215; 206/555; D19/86; D19/91

[58] Field of Search ..... 211/50, 69.1, 11; 206/214, 215, 555; D6/78, 86, 91

[56] References Cited

U.S. PATENT DOCUMENTS

| | | | |
|---|---|---|---|
| D. 362,688 | 9/1995 | Wolff | D19/86 X |
| D. 375,977 | 11/1996 | Swarts | D19/86 X |
| 3,092,379 | 6/1963 | Collier | 206/555 X |
| 4,609,112 | 9/1986 | Belanger et al. | 211/50 X |
| 4,848,584 | 7/1989 | Windorski | 211/50 X |
| 4,946,031 | 8/1990 | Confalonieri | 206/215 X |
| 4,964,519 | 10/1990 | Sugarman et al. | 211/50 |
| 5,427,254 | 6/1995 | Knievriem | 211/50 |
| 5,480,037 | 1/1996 | Pope | 206/215 X |
| 5,607,067 | 3/1997 | Morrissey | 211/50 |

*Primary Examiner*—Robert W. Gibson, Jr.

*Attorney, Agent, or Firm*—McAulay Fisher Nissen Goldberg & Kiel LLP

[57] ABSTRACT

The holder is used for a notepad formed of a stack of note slips which are connected with one another at one of their edges. It has a concave, arc-shaped or gutter-shaped support for the notepad. This support has two edges parallel to its imaginary generating straight line. These two edges project away from the concave support surface. One of the edges has a height (h) which corresponds roughly to the height of the notepad to be received by the holder. The distance (A) between the two edges measured along the concave support corresponds to the width (B) of the notepad to be received. The edge whose height (h) corresponds roughly to the height of the notepad projects away from the concave support approximately at a right angle.

4 Claims, 1 Drawing Sheet

HOLDER FOR A NOTEPAD

BACKGROUND OF THE INVENTION a) Field of the Invention

The invention is directed to a holder for a notepad formed of a stack of note slips which are connected with one another at one of their edges.

b) Description of the Related Art

Notepads are formed of a stack of individual note slips which are glued together at the back in the manner of a book, possibly with a stiffer supporting cardboard lying underneath. In a popular version, these notepads are provided with a stripe of contact adhesive at the edge so that they may be affixed securely to documents or the like but can still be easily removed. This stripe of adhesive also serves, in place of the glued back, to connect the individual slips forming the pad so that they adhere to one another.

A particular problem in notepads of this kind is to store them in a user-friendly fashion such that each individual slip can be removed very easily from the pad without changing the position of the pad and without requiring two hands for this purpose - one hand to tear off the slip and the other hand to hold the pad - wherein the slip to be torn off must be easily accessible. There are already a number of known solutions in which the individual slips are connected in a Z-shaped manner, i.e., the adhesive stripes are located alternately, first on one side then on the other opposite side of the successive slips, the pad being located within a box with a cover in which a slot is provided, one slip succeeding the other through this slot. A disadvantage of this arrangement consists in that it requires special pads which are usually very expensive because of the type of glued connection mentioned above.

SUMMARY OF THE INVENTION

The present invention provides a very simple method for storing known notepads—with or without adhesive stripes—such that they are accessible and easy to grasp and it is characterized by a concave, arc-shaped or gutter-shaped support for the notepad and this support has two edges parallel to its imaginary generating straight line, wherein the two edges project away from the concave support surface and at least one of the edges has a height which corresponds roughly to the height of the notepad to be received by the holder and the distance between the two edges measured along the concave support corresponds to the width of the notepad to be received. The invention makes use of the fact that when the notepad is compressed somewhat by exerting force on two opposite sides of the pad, one of these sides being formed by the contact-adhesive back or glue back, the notepad arches slightly as a whole, wherein the surface forming the contact-adhesive back or glue back is preserved, whereas the edges of the individual note slips are offset relative to one another on the opposite side. The compression (arching) of the opposite sides produces a restoring force by which the pad is held securely between the edges. In order to maintain this slightly arched shape, a slight force is required to take up the restoring capability inherent in the notepad.

The invention is illustrated by means of a more detailed description with reference to the drawing.

DESCRIPTION OF THE PREFERRED EMBODIMENTS

Figure 1:
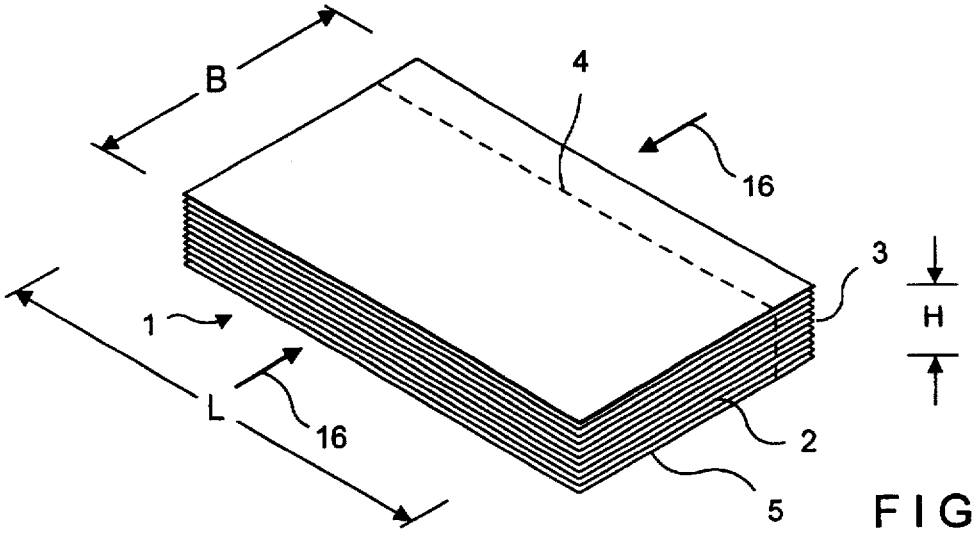
FIG. 1 shows a notepad in an oblique view.
Figure 2:
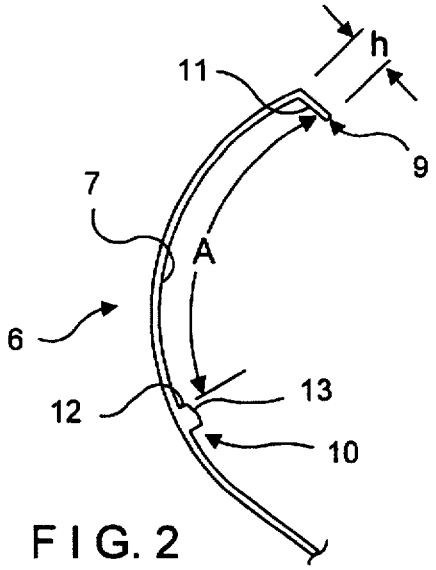
FIG. 2 shows an embodiment form of a holder in a side view.
Figure 3:
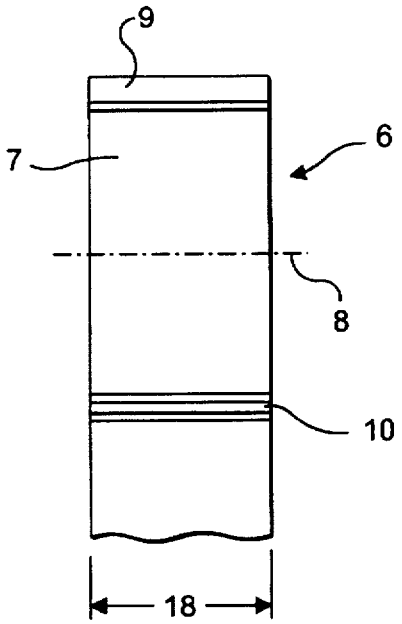
FIG. 3 shows an embodiment form of the holder in a plan view.

FIG. 1 shows a notepad 1 of the kind under consideration which is formed of a stack of note slips 2 of identical shape and ply which are glued together at a shorter side, namely the back 3. In addition to or instead of this gluing on the back, the individual notepads 2 can be coated at one edge with a contact-adhesive stripe, indicated in FIG. 1 by a dashed line 4, by means of which the individual note slips 2 are held together in the pad and by means of which the individual note slips can also be stuck to an object. Such notepads 1 are known in a variety of sizes. The dimensions of this notepad 1 which are mentioned hereinafter are its height H, breadth B and length L. The stack forming the notepad 1 can be fastened to a supporting cardboard 5 or to another elastically deformable support.

According to a first embodiment example, the holder 6 for a notepad 1 of this kind is formed of a concave, arc-shaped or gutter-shaped support 7 which, in the present embodiment example, can be made of a metal strip or plastic strip. However, this support 7 can also be worked or shaped from a solid material such as wood, stone, marble, plastic or the like. This support 7 has two edges 9 and 10 which are parallel to its imaginary generated straight line 8 and project away from the concave surface. The upper, first edge 9 has a height h roughly corresponding to the height H of the notepad 1 to be held. Its actual contact face 11 is approximately at a right angle to the support 7. The second, lower edge 10 has a first portion 12 of a short height projecting approximately at a right angle to the support 7 and a second portion 13 which adjoins the first portion 12, has a flat inclination and is remote of the first edge 9.

The distance A between the two edges 9 and 10 measured along the support 7 corresponds to the breadth B of the notepad 1.

Figure 4:
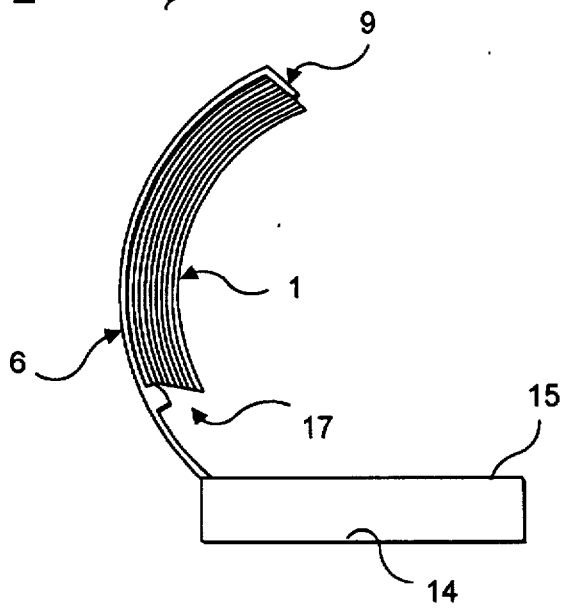
FIG. 4 shows the holder from FIG. 2 with an inserted notepad.

A stand or base 14 can be formed on at the lower edge of the support 7 or of the holder 6 (FIG. 4), this base 14 advisably being formed of a heavy-weight metal or having a contact-adhesive layer at its underside. The upper side 15 of this base 14 can carry a printed advertisement. The breadth (measured at a right angle to the drawing plane in FIG. 4) of this base 14 can be greater than the breadth 18 of the holder 6.

In order to fix the notepad 1 in this holder 6, it is deformed in the shape of a gutter by exerting a slight force on it in the direction of the arrows 16 (FIG. 1), namely such that it curves downward somewhat with reference to FIG. 1. It is inserted into the holder 6 in this curved state (FIG. 4), its glued back 3 snugly contacting the upper edge 9. Since the glued back maintains its position at right angles to the supporting cardboard 5 or to the underside of the notepad 1, the free edges 17 of the notepad 1 are displaced and fanned out relative to one another so that the individual note slips can be removed from the pad without difficulty and with only one hand.

Due to the inherent restoring force in the notepad 1 which is deformed according to the invention, it is held in the holder 6 in the form shown in the drawing without further assistance.

The described embodiment example shows a holder 6 whose breadth 18 is considerably less than the length L of the notepad 1 so that the latter projects beyond the holder at both sides. This holder 6 forms an arc in this case. However, it is also conceivable to make the holder 6 wide so that its breadth 18 corresponds to or is greater than the length L of the notepad. The aforementioned arc shape then changes into a gutter shape. The narrow holder 6 is generally preferred because the corners of the individual note slips of the notepad 1 are then exposed and are therefore easily accessible for grasping.

As was already indicated above, the support 7 contacted by the notepad 1 is not necessarily realized by a metal strip or plastic strip as is shown in the drawings. A curved support 7 of this kind with the edges arranged at the ends can also be worked out of solid material such as wood, stone or marble or from a block of metal or plastic. A holder of this kind is particularly steady.

While the foregoing description and drawings represent the present invention, it will be obvious to those skilled in the art that various changes may be made therein without departing from the true spirit and scope of the present invention.

Reference Numbers

1 notepad
2 note slip
3 back
4 dashed line
5 supporting cardboard
6 holder
7 support
8 generating line
9 first, upper edge
10 second, lower edge

11 contact face
12 first portion
13 second portion
14 base
15 upper side
16 arrow
17 free edges
18 breadth

What is claimed is:

1. A holder for a notepad formed of a stack of note slips which are connected with one another at one of their edges, comprising:

a concave, arc-shaped support for the notepad, said support having two edges parallel to an imaginary generating straight line, wherein the two edges project away from a concave support surface thereof and at least one of the edges having a height (h) which corresponds roughly to the height (H) of the notepad to be received by said holder; a distance (A) between the two edges being measured along said concave support corresponding to a width (B) of the notepad to be received.

2. The holder according to claim 1, wherein the support is narrower than the notepad to be received.

3. The holder according to claim 1, wherein the edge whose height (h) corresponds roughly to the height (H) of the notepad projecting away from the concave support approximately at a right angle.

4. The holder according to claim 1, wherein a side of the edge facing the edge having a height approximately that of the notepad height having a first portion which is approximately at a right angle to the concave support and a second portion which adjoins said first portion, is inclined at a flat angle and is remote of said first edge.

* * * * *